US011034475B2

(12) United States Patent
Delage

(10) Patent No.: US 11,034,475 B2
(45) Date of Patent: Jun. 15, 2021

(54) DEVICE AND METHOD FOR PRESSURE-PACKAGING A CONTAINER TO BE PROCESSED AND ASSOCIATED PRESSURE-PACKAGING MACHINE

(71) Applicant: JALCA, Le Havre (FR)

(72) Inventor: Jean-Guy Delage, Le Havre (FR)

(73) Assignee: JALCA, Le Havre (FR)

( * ) Notice: Subject to any disclaimer, the term of this patent is extended or adjusted under 35 U.S.C. 154(b) by 231 days.

(21) Appl. No.: 16/347,444

(22) PCT Filed: Nov. 2, 2017

(86) PCT No.: PCT/FR2017/053004
§ 371 (c)(1),
(2) Date: May 3, 2019

(87) PCT Pub. No.: WO2018/083419
PCT Pub. Date: May 11, 2018

(65) Prior Publication Data

US 2019/0329920 A1 Oct. 31, 2019

(30) Foreign Application Priority Data

Nov. 4, 2016 (FR) ..... 1660720

(51) Int. Cl.
*B65B 31/04* (2006.01)
*B65B 31/00* (2006.01)
(Continued)

(52) U.S. Cl.
CPC ..... *B65B 31/046* (2013.01); *B65B 31/006* (2013.01); *B65B 31/08* (2013.01);
(Continued)

(58) Field of Classification Search
CPC ..... B65B 31/046; B65B 31/006; B65B 31/08; B65B 31/00; B65B 31/04; B65B 31/06;
(Continued)

(56) References Cited

U.S. PATENT DOCUMENTS 234,674 A * 11/1880 Ingersoll ..... B67B 3/24 53/404
1,207,814 A * 12/1916 Stockton ..... F17C 5/06 53/404
(Continued)

FOREIGN PATENT DOCUMENTS

FR 2322062 A1 3/1977
GB 1561143 A 2/1980
(Continued)

OTHER PUBLICATIONS

Office Action issued in Japanese Patent Application No. 2019-523104 dated Sep. 29, 2020 with English translation provided.
(Continued)

*Primary Examiner* — Dariush Seif
(74) *Attorney, Agent, or Firm* — Nixon & Vanderhye

(57) ABSTRACT

Disclosed is a device and a method for pressure-packaging a container to be processed, which is sealed by a stopper, the device including a cap with a needle, a fluid injector, and a heating cannula, the cap being designed to be applied to the stopper in a tight manner, the needle being able to move so as to pierce a hole through the stopper, the cannula being able to move so as to close the hole by the melting of the material of the stopper, the needle and the cannula being arranged such that the axes of movement thereof are secant at a point located in the stopper, the end of the cannula being convex.

18 Claims, 7 Drawing Sheets

(51) Int. Cl.
*B65B 31/08* (2006.01)
*B65B 57/00* (2006.01)
*B67C 3/22* (2006.01)

(52) U.S. Cl.
CPC ..... *B65B 57/00* (2013.01); *B67C 3/22* (2013.01); *B67C 2003/226* (2013.01)

(58) Field of Classification Search
CPC .. B65B 57/00; B67C 3/22; B67C 3/02; B67C 3/06; B67C 2003/226
USPC ..... 53/404
See application file for complete search history.

(56) References Cited

U.S. PATENT DOCUMENTS 2,125,316 A * 8/1938 Ronci ..... H01J 9/40 445/43
2,855,006 A * 10/1958 Geisler ..... B65B 31/08 141/7
2,856,739 A * 10/1958 Mazzagatti ..... H01J 47/00 53/404
3,996,725 A * 12/1976 Walles ..... B65B 31/027 53/94
4,597,245 A * 7/1986 Parker ..... B65B 31/06 53/268
9,428,292 B2 * 8/2016 Taber ..... B65B 31/06
9,643,746 B1 * 5/2017 Lunn ..... B65B 31/08
2009/0313954 A1 * 12/2009 Aarts ..... G01M 3/366 53/510
2011/0094618 A1 * 4/2011 Melrose ..... B65B 31/06 141/11
2012/0311966 A1 * 12/2012 Melrose ..... B67B 3/00 53/403
2013/0055679 A1 * 3/2013 Melrose ..... B65D 47/243 53/432
2013/0247513 A1 * 9/2013 Melrose ..... B65D 47/30 53/287
2013/0291494 A1 * 11/2013 Melrose ..... B65B 7/2807 53/476
2014/0260100 A1 * 9/2014 Taber ..... B65B 31/06 53/436
2015/0121807 A1 * 5/2015 Taber ..... B65B 31/08 53/431
2017/0008745 A1 * 1/2017 Melrose ..... B67C 3/222
2017/0305581 A1 * 10/2017 Melrose ..... B65D 47/30
2018/0127126 A1 * 5/2018 Delage ..... B65B 31/006

FOREIGN PATENT DOCUMENTS

JP S52-029382 A 3/1977
JP 2011-520721 A 7/2011
WO 2009/142510 A1 11/2009
WO 2016/177987 A1 11/2016

OTHER PUBLICATIONS

International Search Report, dated Feb. 13, 2018, from corresponding PCT application No. PCT/FR2017/053004.

* cited by examiner

DEVICE AND METHOD FOR PRESSURE-PACKAGING A CONTAINER TO BE PROCESSED AND ASSOCIATED PRESSURE-PACKAGING MACHINE

The present invention relates to the bottling field, and more particularly to a device and a method for pressure-packaging a container to be processed at least partially filled with contents and stoppered in a tight manner by a stopper arranged above a head space of the container, and to an associated pressure-packaging machine.

Hereinafter, contents refer to a liquid or semiliquid food product intended to be marketed outside the cold chain, such as an acidic fruit juice, in a container, a container within the meaning of the present invention being an enclosure made from a polymer material such as a bottle, provided with a stopper of a known type, intended to hermetically close the bottle after filling, generally by screwing.

The liquid or semiliquid food contents are sensitive to microbial development and the organoleptic qualities are very quickly altered in the absence of sterilization treatment of the pathogenic organisms and/or the presence of oxygen.

In a known manner, heat treatment at a high temperature of about 90° C. for several seconds, also called flash pasteurization, is also applied to food liquids or semi-liquids having a pH below 4.7, such as juices. In this known method, the liquid is treated in a specific unit, before filling, which must be done in a sterile manner. It is therefore necessary to make sure that the chain remains sterile.

This known filling method consists of cold filling in a sterile atmosphere, the container and its stopper being cold sterilized using a sterilization liquid, then rinsing, and the contents next being introduced into this container in an aseptic atmosphere. The advantage is the use of packages that require little material, since the necessary mechanical properties are limited. The method does not cause volume variations related to the temperature variations. Furthermore, the necessary mechanical properties being limited, the outer esthetic shapes are freer. Nevertheless, the oxygen contained in the head space can be consumed, and a vacuum then occurs in the bottle. It is therefore necessary to provide either a bottle withstanding this vacuum, or compensation for this vacuum.

This "sterile" technique causes complex, costly installations and rigorous as well as costly upkeep. Furthermore, quality control can only be done by sampling, and there is therefore no systematic control and thus no certainty regarding the sterilization of the liquid or semiliquid food content packaged in this way.

Another known solution is that of sterilization simultaneously with filling by introducing a sterilizing liquid. It is understood that the addition of a sterilizing product, which is a chemical compound, is not necessarily accepted by all sanitary laws in countries and that consumers themselves may be reluctant to absorb not only the liquid or semiliquid food product they have chosen, but also the residual sterilizing product introduced. Such preservatives may cause changes to the organoleptic qualities during conservation after opening the package.

A last solution among the main solutions known from the prior art consists of hot filling a container, i.e., introducing the contents brought to a high temperature directly into the container without the latter having undergone a sterilization treatment. In this case, the contents themselves sterilize the container, since they are introduced at a temperature enabling the destruction of pathogenic organisms, therefore above 73° C., generally 85° C. The package is closed, then immediately agitated, generally by turning it over, in order to heat treat all of the inner surfaces of the container, including the inner face of the stopper.

In the case of hot stoppering, the stopper is a stopper of a known type, made from a single material, obtained by molding, inspected before placement to avoid any placement of a defective stopper. Such stoppers are extremely inexpensive.

This solution is interesting because it guarantees that each package is necessarily inwardly sterilized, without anything being able to be missed.

If the stopper is inexpensive, the drawback of hot filling is that it requires a container that withstands the temperature on the one hand and the collapse phenomenon on the other hand related to the shrinkage of the volume of liquid during cooling, which creates a vacuum inside said container. Furthermore, the oxygen from the air captured during filling is also "consumed" after cooling by the liquid or semiliquid food composition, which causes a deferred vacuum that may also cause an additional deformation of the container.

The package, which must therefore be mechanically strong and/or deformable, requires a large quantity of material and often a specific architecture with panels to withstand the deformations of this package and/or to compensate the vacuum by appropriate deformations. Thus, bottoms may assume two positions, including a position inwardly deformed under the effect of the vacuum so as to compensate said vacuum. The deformation of the bottom being below the bottle, this does not cause any stability problem of the bottle when it is placed on said bottom, only the hollowing of the bottom is more pronounced, which is invisible unless one looks underneath. It is understood that such a bottom must be sophisticated, is complex to produce and causes an obvious excess cost.

It should be noted that this is also counter to sustainable development needs, which seek to decrease the quantities of polymer materials used, which also affects the manufacturing cost and recycling, therefore the end cost.

Nevertheless, this method requires the simplest packaging lines both in terms of installation and maintenance, which is easy to inspect, since the main inspection relates to a single parameter: the temperature of the contents.

Other compensation solutions have been implemented: one of them for example consists of introducing a drop of liquid nitrogen into the head space immediately before stoppering. The liquid nitrogen enters the gaseous state with a very strong increase in volume, which places the volume of the bottle under pressure and makes it possible to compensate the shrinkage volume of the liquid as cooling occurs. In the final state, at ambient temperature, the balance is found and the nitrogen can only cause additional inerting. However, this method is relatively complex to master and fairly difficult to reproduce.

Progress in the methods and materials of containers has made it possible to improve performance. Nevertheless, the aim, which is also that of the present invention, is to be able to proceed in particular with hot filling by using bottles having the smallest possible extra weight of material relative to the containers used for cold filling in a sterile atmosphere.

It is also useful to be able to compensate the vacuum in cold-filled containers, which may also undergo deformations by vacuum, or to improve their mechanical strength, especially if the containers themselves have a low mechanical strength, which is also an aim of the present invention.

It is therefore necessary to propose a method for compensating the vacuum in a container, at least, and more generally for controlling the overpressure, in particular in the case of hot filling. This overpressure, after cooling, makes it possible to compensate the decreased volume of the head space, which is several percent upon cooling. This overpressure makes it possible also to compensate, over time, the decreased pressure related to oxygen consumption.

These different sources of decreased pressure, when no compensation or even no over-pressurization is provided, cause a deformation of the bottle and make it unsuitable for sale. These vacuums also lead to poor gripping by consumers, as well as poor mechanical strength of the containers during transport in pallets, even film-wrapped.

Patents are known that have proposed a compensating method, such as patent applications FR 2,322,062 A1 and US 2015/0121807 A1, which propose to inject a gaseous fluid into the head space through a specific stoppering member. Such a device consists of inserting a needle through the stoppering member, injecting a gas through the needle into the head space and removing said needle, the stoppering member itself guaranteeing the tightness. It happens that a stoppering member is necessary that is provided with specific means, which is completely prohibitive with respect to the cost of the packaging. On top of the price and in addition, this creates complex problems related to the presence of several materials, the complexity of the quality inspection, recycling difficulties, and the uncertainty of quality stoppering. In the case at hand, a membrane is provided that can only serve as a barrier for the liquid during hot filling for example, since the liquid will not pass behind the membrane, since the stoppering member is perforated, which introduces potential organisms included behind the membrane that will migrate into the container.

Another device also uses an even more specific stopper, that described in patent application WO 2009142510 A1. This stopper is the made with an opening. After filling, the head space is placed in a pressurized chamber, a stopper pin is introduced into the hole arranged to that end, said stopper being immobilized in the hole by mechanical means. Such a method is completely industrially impracticable, in terms of rhythms and price and inspection difficulties, as well as even putting into practice difficulties.

Furthermore, the devices known in the state of the art do not allow a precise verification of the sealing quality of the hole formed in the stopper in order to guarantee perfect tightness of the container.

The present invention seeks to resolve the drawbacks of the prior art by proposing a device and method for pressure-packaging of a container to be processed at least partially filled with contents and stoppered in a tight manner by a stopper arranged above a head space of the container, said device comprising a cap with a needle and a heating cannula that are arranged therein such that the respective movement axes thereof are secant at a point situated in the material of the stopper or above the material of the stopper when the cap is engaged over the stopper, the end of the heating cannula being convex, preferably hemispherical, which makes it possible in particular to be able to proceed with hot filling using bottles with the smallest possible extra weight of material relative to the containers used for cold filling in a sterile atmosphere, and which also makes it possible to compensate the vacuum in cold-filled containers that may undergo vacuum deformations, especially if the containers themselves have a low mechanical strength. Furthermore, the convex shape of the end of the heating cannula makes it possible to perform a precise verification of the sealing quality by the heating cannula of the hole formed in the stopper by the needle.

The present invention therefore relates to a device for pressure-packaging a container to be processed at least partially filled with contents and sealed in a tight manner by a stopper arranged over a head space of the container, said device comprising a cap that comprises, inside it, a piercing needle, fluid injection means and a heating cannula for sealing by melting, said cap being configured to be engaged sealingly over the outer surface of the stopper, said needle being adapted to move linearly to pierce a hole through the stopper, said fluid injection means being configured to introduce a fluid in the head space via said hole, said heating cannula being adapted to move linearly to seal said hole by melting the material of the stopper, characterized in that the needle and the heating cannula are arranged in the cap such that their respective axes of movement are secant at a point located in the material of the stopper or above the material of the stopper when the cap is engaged over the stopper, and by the fact that the end of the heating cannula is convex.

The end of the heating cannula is preferably hemispherical.

Thus, said device for pressure-packaging a container to be processed makes it possible in particular to perform hot-filling using bottles having the smallest possible extra quantity of material relative to the containers used for cold-filling in a sterile atmosphere, and also makes it possible to compensate the vacuum in cold-filled containers that may undergo vacuum deformations, in particular if the containers themselves have a low mechanical strength.

The needle and the heating cannula are inclined relative to one another such that their respective longitudinal axes of movement are secant at a same point in the material of the stopper or above the material of the stopper. Preferably, said point is located at the center of the upper surface of the stopper.

One skilled in the art may easily proceed by trials and measurements such that in the sealing position of the heating cannula on the stopper, the apex of the convex shape of the cannula coincides with the hole formed by the needle: the axes of movement are thus secant on the material of the stopper or above it, as a function of the convex shape adopted by the end of the heating cannula.

The needle is movable, in the position of the cap engaged over the stopper, between a retracted position and a piercing position to pierce the stopper. The heating cannula is movable, in the position of the cap engaged over the stopper, between an idle position and a sealing position to seal, by melting, the hole formed in the stopper by the needle, the plastic material of the stopper melting in contact with the heating cannula.

The needle is never in contact with the contents during the piercing.

The stopper used in the context of the invention and therefore in this method is a traditional single-piece stopper, with no inner membrane, and is therefore inexpensive and easy to recycle. The invention is not, however, limited in this respect. As a non-limiting example, the following stoppers are also within the scope of the present invention, and can be used with the inventive method:

- a stopper comprising an annular membrane (or inner coating or liner) hollowed out in its central part,
- a stopper comprising a solid membrane (or solid inner coating or liner), but with a central thickness smaller than the minimum thickness needed for self-sealing in the case of a piercing and a consecutive withdrawal of a needle from the stopper, this minimum needed thickness being less than 0.2 mm, a stopper comprising a solid membrane (or solid inner coating or liner) with a thickness between 0.2 mm and 0.8 mm, with a material of the polyethylene/ethylene vinyl acetate (PE/EVA) type that does not have proven self-stoppering characteristics after withdrawal of a piercing needle with a diameter between 0.1 mm and 3 mm.

This device is preferably used for hot-filling with contents, but can also be used for cold-filling with contents.

The heating cannula makes it possible to re-stopper, by melting the plastic material of the stopper, the hole formed in the stopper by the needle, which makes it possible to guarantee the final tightness of the container while compensating the vacuum in the container.

The container thus contains contents at least with a balanced pressure and preferably under a slight pressure so that the internal pressure difference with respect to the pressure outside the container avoids generating any collapse of the container.

Furthermore, the convex, preferably hemispherical, shape of the end of the heating cannula makes it possible to perform a precise verification of the sealing quality by the heating cannula of a hole formed in the stopper by the needle. Indeed, the shape of the sealing formed by the convex heating cannula depends on the shape of the end of the heating cannula, the temperature of the end of the heating cannula, the contact time of the heating cannula with the stopper and the penetration depth of the heating cannula in the stopper. Once the convex shape of the end of the heating cannula is known, the temperature of the end of the heating cannula determined as a function of the component material of the stopper, the contact time determined as a function of the desired processing time, one skilled in the art will be able to adapt the penetration depth in the stopper through trials and measurements. A characteristic mark of a certain diameter will be formed on the upper surface of the stopper, which, the shape, the temperature of the end of the cannula and the contact time being known, will make it possible to guarantee that the heating cannula has had a sufficient penetration to guarantee a tight seal. It is of course understood that, only the convex shape of the end of the heating cannula being given, one skilled in the art may set two parameters from among the temperature of the end of the heating cannula, the contact time and the penetration depth to adapt the third parameter in order to determine the mark of the heating cannula on the upper surface of the stopper that guarantees an optimal tight seal.

According to one particular feature of the invention, the device further comprises an optical means configured to verify the sealing quality of the hole in the stopper by the heating cannula. The optical means can be a camera or an optical fiber connected to an optical sensor. The optical means can be arranged in the cap or on a station downstream on a production line having the device of the invention.

Thus, it is possible to verify optically, using the optical camera, whether the sealing quality of the hole by the heating cannula is good or bad, in order to perform the step of sealing by melting again or to throw away the stopper/the container if a poor sealing quality is detected.

According to one particular feature of the invention, the device further comprises an optical or inductive means arranged in the cap and configured to verify the integrity of the needle after the piercing of the hole.

Thus, it is possible to verify optically, using this optical or inductive means, whether the needle is broken after the piercing step, in order to replace the needle and throw away the contents of the container if a broken needle is detected.

An offboard optical camera can check the filling level of the container at the end of the pressure-packaging method to detect any break of the needle. Indeed, during normal processing, the content level should drop to a predetermined level, whereas in case of non-piercing and therefore non-introduction of fluid, the content level will not drop.

A proximity detector system could also check the presence of the whole and unbroken needle. Such proximity detector systems could for example be a photoelectric or magnetic cell.

According to one particular feature of the invention, the needle has a pointed and cone-shaped end.

Thus, said needle is more solid compared to a hypodermic needle with a beveled end used in the prior art, which makes it possible to prevent said needle from breaking during the piercing step.

Said needle provides a hole by penetration in the plastic material of the stopper, by deformation and pushing back of the material, without tearing material. No plastic stopper waste thus falls into the contents of the container.

The diameter of the piercing hole must make it possible to combine rapid swelling (largest possible diameter) and welding safety (smallest possible diameter). As a non-limiting example, a needle diameter of 0.7 mm seems to be a good compromise. It is of course understood that the invention is not limited in this regard, the diameter of the needle being adapted to be between 0.3 and 0.8 times the thickness of the stopper. The thickness of the stopper is defined as the maximum thickness of the flat surface of the stopper from which the skirt of the stopper bearing the screw pitch extends.

According to a first embodiment of the invention, the needle is solid, the fluid injection means comprising at least one fluid inlet adapted to receive a pressurized fluid and to inject the latter inside the cap engaged sealingly over the stopper.

Thus, during the fluid injection, the solid needle is removed from the hole formed in the stopper in order to allow the introduction of the fluid into the head space of the container by means of said hole. In this first embodiment, a sterilization of the outer surface of the stopper before the engagement of the cap over the stopper is mandatory so as not to pollute the contents during the introduction of the fluid into the head space.

The removal of the needle during the injection of fluid also makes it possible to avoid any splashing of the contents onto the needle during the introduction of fluid, which creates turbulence of the surface of the contents, for improved hygiene.

According to a second embodiment of the invention, the pointed end of the needle is solid, and the rest of the needle comprises a longitudinal central bore and at least two opposed lateral holes connecting said central bore with the outside of the needle near the pointed end of the needle, the fluid injection means comprising at least one fluid inlet adapted to receive a pressurized fluid and to inject the latter into the central bore of the needle at the end of the needle opposite the pointed end of the needle.

Thus, the needle is solid at its tip, but pierced in its center with two lateral openings, which makes it possible to perform a fluid introduction into the head space of the container while the needle is still in its piercing position, the fluid being spread laterally into the head space by the two lateral holes of the needle, thus making it possible to avoid any creation of turbulence of the contents and splashing during the introduction of fluid. This second embodiment makes it possible to avoid prior sterilization of the outer surface of the stopper, which is an important point from an industrial perspective.

According to one particular feature of the invention, the needle is heated by a heating means.

Thus, the heating of the needle makes it possible both to sterilize the needle and to facilitate the piercing of the plastic material of the stopper. The needle is preferably heated to a temperature above 95° C. for sterilization and below 130° C. to avoid possible melting of the plastic material of the stopper during piercing and an adhesion of plastic particles on the needle, which could next detach therefrom during piercing of the stopper of another container in a future cycle.

The temperature of the needle is preferably maintained and monitored at all times by a resistance/probe placed in the needle holder.

The present invention also relates to a method for pressure-packaging a container to be processed at least partially filled with contents and stoppered in a tight manner by a stopper arranged above a head space of the container, using a pressure-packaging device as described above, characterized in that it comprises the following steps: sealingly engaging the cap of said device over the outer surface of the stopper; piercing a hole through the stopper using the needle of said device; introducing a fluid in the head space of the container by means of said hole, arranged through the stopper, using fluid injection means of said device, so as to obtain a residual pressure at least equal to the atmospheric pressure in the head space of the container; sealing said hole by melting of the material of the stopper using the heating cannula; and removing the cap.

Thus, said method for pressure-packaging a container to be processed makes it possible in particular to proceed with hot-filling by using bottles having the smallest possible extra weight of material relative to the containers used for cold-filling in a sterile atmosphere, and also makes it possible to compensate the vacuum in cold-filled containers that may undergo deformations by vacuum, in particular if the containers themselves have a low mechanical strength.

The temperature of the heating cannula and the contact time may be configured individually to obtain the desired penetration/welding and are monitored continuously by the pressure packaging device.

The temperature at the end of the heating cannula is about 140° C.-220° C. in order to guarantee the rapid melting of the plastic material of the stopper.

A minimal force, for example using an hydraulic cylinder controlled at 7 bars, is applied to the heating cannula to guarantee a significant compression of the plastic during the melting phase to fill the hole. An insufficient pressure of the heating cannula despite the proper temperature and the proper contact time compromises the quality/sealing of the welding. Experimentally, the applicant has noted good welding imprints for contact time of 0.4-0.5 seconds, under 7 bars, with a temperature of 180° C. at the end of the cannula, for high-density polyethylene (HDPE) stoppers.

The heating of the cannula is guaranteed by a resistance/temperature probe connected to the device.

A water cooling circuit placed in the cap preferably guarantees that the cap is kept at a "reasonable" temperature.

According to the first embodiment of the pressure-packaging device according to the invention, the needle is removed from the hole before the fluid introduction step.

Thus, the engagement of the cap over the stopper being done sealingly, the needle can be raised, before the fluid injection step, while maintaining the pressure between the cap and the stopper, the piercing is therefore "clean" without shavings, or waste by pushing back plastic material from the stopper only, the removal of the needle during the fluid injection also making it possible to avoid any splashes of the contents on the needle during the fluid introduction that creates turbulence on the surface of the contents, for improved hygiene.

According to the second embodiment of the pressure-packaging device of the invention, the needle is kept in the hole during the fluid introduction step, the fluid introduction being done through the central bore and the at least two lateral holes of the needle.

Thus, the fluid is spread laterally in the head space through the two lateral holes of the needle, thus making it possible to avoid any creation of turbulence of the contents and splashes during the introduction of fluid, and also making it possible to avoid the prior sterilization of the outer surface of the stopper.

According to one particular feature of the invention, the method further comprises, after the sealing step, a step for verifying the sealing quality of the hole in the stopper using the optical means.

Leak test systems are currently available to test the quality of the weld. However, for a hole of about a micron (which allows the return of atmospheric pressure for the container in a week), the test time is about thirty seconds; it would therefore take a number of tests caps fifteen times greater than the number of processing caps, with is prohibitive.

The optical means therefore makes it possible to verify the sealing quality immediately after the sealing step when the cap is still engaged over the stopper, or on a station downstream on a production line in which the device according to the invention is placed.

According to one particular feature of the invention, the verification step comprises the following sub-steps: the capture, by the optical means, of an image of the stopper at the circular seal formed by the convex heating cannula; the measurement of the diameter of the captured circular seal; and the comparison of the measured diameter to a threshold value in order to determine whether the sealing quality is acceptable.

Thus, the optical means allows a visual inspection of the sealing by melting in order to measure the penetration of the cannula and guarantee the quality of the weld.

According to one particular feature of the invention, the fluid introduction step into the head space comprises an introduction of fluid in an initial phase at a first pressure value, then introduction of fluid in a final phase at a second pressure value lower than the first pressure value for an acceleration of the method according to the invention.

Thus, it is possible to greatly increase the pressure in the initial phase of the pressurization immediately after the piercing, and to have a lower pressure in the final phase in order to adjust the final pressure just before the sealing by melting.

According to one particular feature of the invention, in the case of hot-filling at a temperature above 73° C., the fluid is introduced in the head space after cooling of the contents to a temperature below 45° C.

According to one particular feature of the invention, the fluid introduction pressure is configured to generate a residual pressure in the container, comprised between 1.01 bars and 2.5 bars, and preferably between 1.01 bars and 1.4 bars.

According to one particular feature of the invention, the fluid is an inert and sterile gas such as nitrogen, in particular in gaseous form.

Thus, the inert and sterile gas makes it possible not to cause later oxidation of the contents, after bottling. This avoids over-collapse due to later oxygen consumption, since there is none or very little, the inert gas having in large part replaced the initially confined air.

According to another particular feature of the invention, the method further comprises, before, during and/or after the step for engaging the cap over the stopper, a step for circulating sterile fluid between the cap and the stopper, preferably an inert gas, still more preferably nitrogen.

Thus, this circulation of sterile fluid makes it possible to prevent bacteria from entering the space between the cap and the stopper from the outside, in order to guarantee the stability of the container. An overpressure is created between the stopper and the cap in order to maintain a positive pressure greater than or equal to the pressure inside the container until sealing by melting.

According to one particular feature of the invention, the method further comprises, before the step for engagement of the cap over the stopper, a step for sterilization of the outer surface of the stopper by one or several from among punctual heating, chemical sterilization, vapor, an emission of pulsed light or another similar method.

Thus, punctual heating or chemical sterilization using a sterilizing liquid guarantees the destruction of pathogenic organisms present on the outer surface of the stopper.

The present invention further relates to a pressure packaging machine comprising at least one pressure-packaging device as described above, said pressure-packaging machine further comprising a means for keeping the container in position relative to which the cap of the at least one pressure-packaging device is movable between an idle position distant from the means for keeping the container in position and an engagement means in which the cap is engaged sealingly over the stopper of the container to be processed.

To better illustrate the subject matter of the present invention, below we will describe, as a non-limiting illustration, two preferred embodiments, in reference to the appended drawings.

In these drawings:

FIG. 1 shows a device 1 for pressure-packaging a container to be processed 2.

Figure 1:
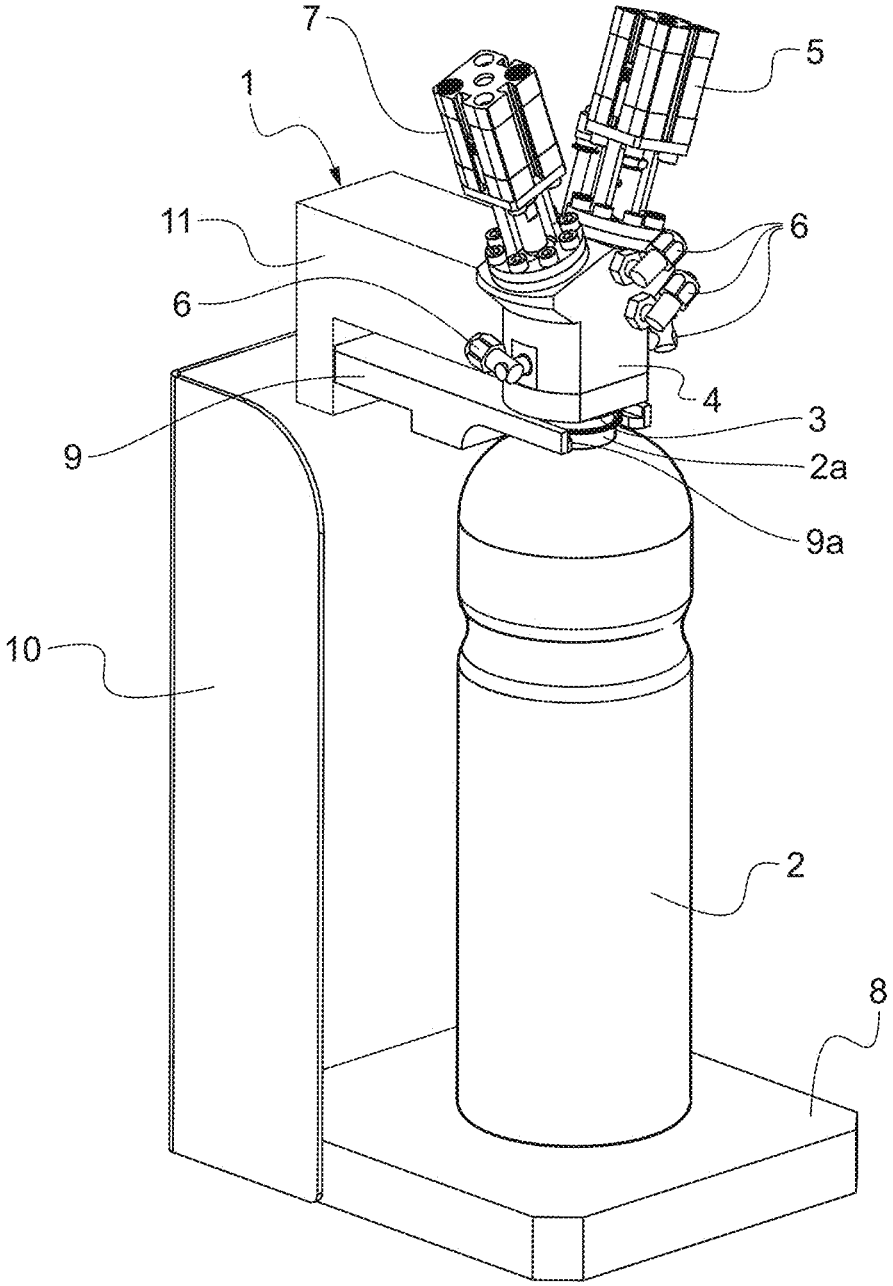
FIG. 1 is a perspective view of a device for pressure-packaging a container to be processed according to the present invention.

The container to be processed 2 is at least partially filled with contents and stoppered in a tight manner by a stopper 3 arranged above a head space of the container 2.

In the case of the present description, the container 2 undergoes hot filling, and is a bottle, in particular made from PET (polyethylene terephthalate), with a low grammage, with contents, such as fruit juice, brought to a temperature capable of destroying pathogenic organisms, namely a temperature above 73° C. and in the case at hand 85° C.

Once the container 2 is filled with the hot contents, it is stoppered by the stopper 3 of a known type, in particular an injection- or compression-molded screwcap, monolithic and made from a single material, free of any additional sealing element.

The tightness is obtained by contact under mechanical pressure of the material of the stopper 3, in the case at hand of its inner face, on the material of the peripheral edge of the neck 2*a* of the container 2, the screwing making it possible to exert said necessary mechanical pressure.

During closing, said stopper 3 allows a head space to remain. This space results from the filling without overflow, since the contents must not in any case overflow and find themselves on the lip of the neck 2*a* before closing, since the contents would then be an entryway below the stopper 3 and the container 2 would be unsuitable for sale.

The stopper 3 is free of any mechanism or any other accessory for compensating for pressure. The air captured in the head space is hot, but at atmospheric pressure.

It should be noted that the present invention also applies to certain stoppers commonly used, in particular in the United States, that are of the dual-material type with an inner membrane used to guarantee only the tightness between the surface of the neck of the container 2 and the stopper 3 by compression during screwing, unlike the inner lip for stoppers of the single-material type. However, this inner membrane for such a dual-material stopper does not have the necessary characteristics to guarantee self-sealing of the stopper in the case of piercing using a needle, then a removal of the needle outside the stopper.

The container 2 is adapted to receive contents at the selected sterilization temperature without damage, but is free of vacuum compensation means.

The container 2 is set in motion immediately after filling with the contents, in order to place all of the inner surfaces of the container 2 in contact with the contents brought to the sterilizing temperature.

The container 2 and its contents are next cooled in a cooling tunnel by spraying water, for example to bring the assembly close to ambient temperature.

When the container 2 reaches a temperature below 75° C., due to its component material, said container 2 collapses on itself because the volume of gas and liquid is reduced to 3 to 5% inside the container 2. This reduction increases over the course of the cooling. The collapse phenomenon is close to its maximum at a temperature of less than or equal to 45° C.

The pressure-packaging device 1 comprises a cap 4, also called engagement head, that comprises, inside it, piercing means 5, fluid injection means 6 and means of sealing by melting 7.

The pressure-packaging device 1 further comprises a horizontal lower support 8 on which the container 2 is positioned, a horizontal upper support 9 comprising a notch 9*a* in which the neck 2*a* of the container 2 is inserted, and a vertical support 10 to which the lower support 8 and the upper support 9 are connected.

The cap 4 is vertically movable, by means of a vertical movement motor 11, between an idle position at a distance from the upper support 9 and an engagement position in which the cap 4 is engaged sealingly over the stopper 3 of the container to be processed 2. It is of course understood that the invention is not limited in this respect: either the cap is movable, engaged over the container brought below the cap, or the cap is stationary, the container being brought into the cap.

The pressure-packaging device 1 is configured to carry out a method for pressure-packaging the container to be processed 2 that comprises the following steps: engaging the cap 4 sealingly on the outer surface of the stopper 3; piercing a hole through the stopper 3 by lowering piercing means 5 toward the stopper 3; introducing a fluid into the head space of the container 2 by means of said hole, arranged through the stopper 3, using fluid injection means 6, so as to obtain a residual pressure at least equal to the atmospheric pressure in the head space of the container 2; sealing said hole of the stopper 3 by melting of the material of the stopper 3 by lowering means for sealing by melting 7 toward the stopper 3; and removing the cap 4. The different steps of the method will be described in more detail in FIGS. 2 to 6.

The engagement of the cap 4 over the stopper 3 being done sealingly, in the first embodiment of the invention, the piercing means 5 can be raised, before the fluid injection step, while maintaining the pressure between the cap 4 and the stopper 3, the piercing is therefore "clean" without shavings, or waste by pushing back plastic material from the stopper 3 only, the removal of the piercing means 5 during the fluid injection also making it possible to avoid any splashes of the contents on the piercing means 5 for improved hygiene.

The stopper 3 used in this method is a traditional single-piece stopper, with no inner membrane, and is therefore inexpensive.

The container 2 thus contains contents at least with a balanced pressure and preferably under a slight pressure so that the internal pressure difference with respect to the pressure outside the container 2 avoids generating any collapse of the container 2.

Figure 2:
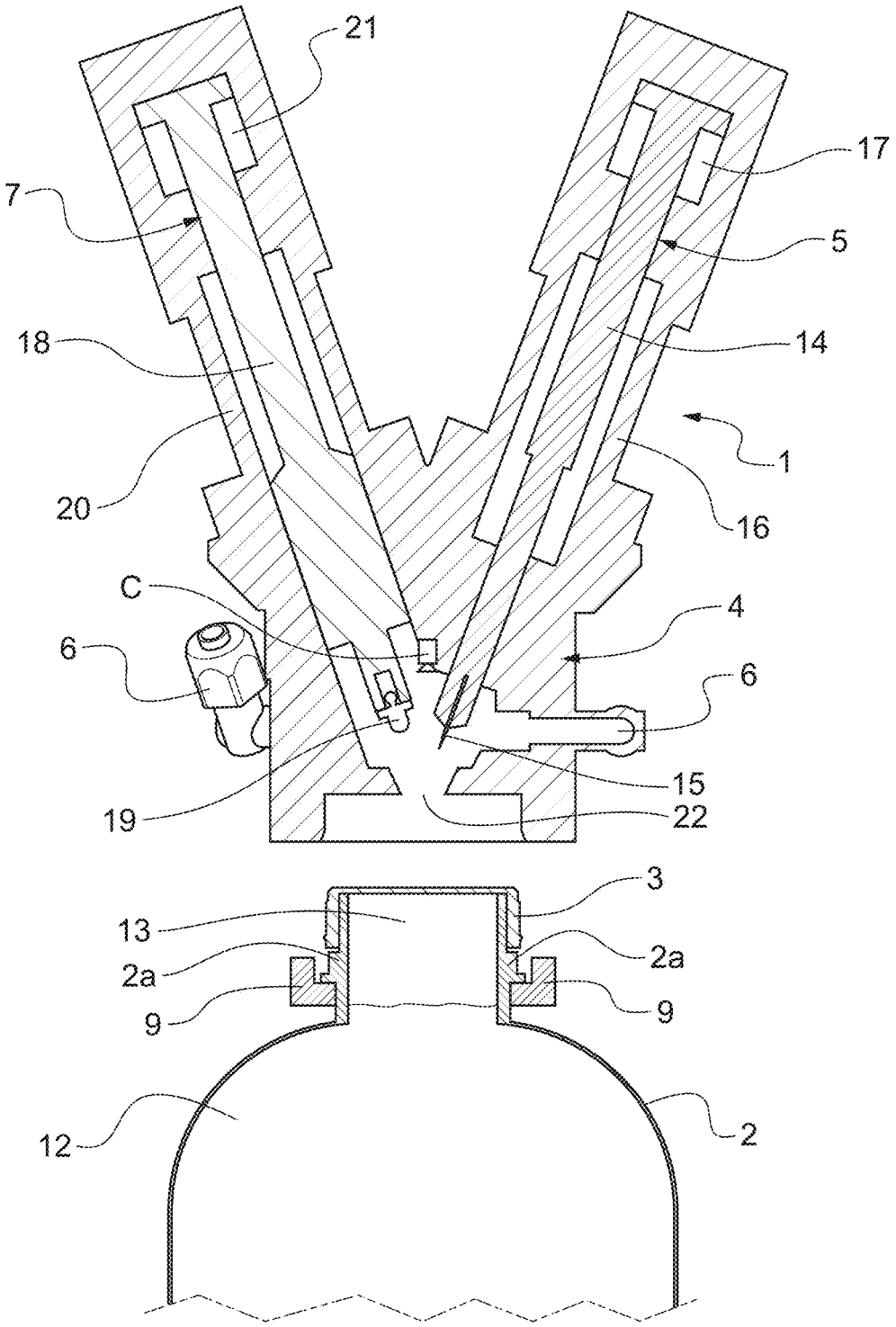
FIG. 2 is a sectional view of the device of FIG. 1 in the non-engaged position.

FIG. 2 shows the pressure-packaging device 1 in the non-engaged position of the cap 4.

The container 2 is partially filled with contents 12 such that a head space 13 without contents remains at the neck 2*a* of the container 2, the container 2 being stoppered in a tight manner by the stopper 3 arranged above the head space 13 of the container 2.

The piercing means 5 comprise a piston 14 at the end of which a needle 15 is provided, said piston 14 being adapted to move linearly in a cylinder 16 formed on the cap 4, the travel of the piston 14 being limited by a piston chamber 17 formed in the upper end of the cylinder 16.

Thus, the needle 15 is configured to pierce the stopper 3 when the cap 4 is engaged over the stopper 3 and the piston 14 is in its deployed position.

The means for sealing by melting 7 comprise a piston 18 at the end of which a heating cannula 19 is fastened, said piston 18 being adapted to move linearly in a cylinder 20 formed on the cap 4, the travel of the piston 18 being limited by a piston chamber 21 formed in the upper end of the cylinder 20.

Thus, the heating cannula 19 is configured to seal, by melting, the hole formed in the stopper 3 by the needle 15 when the cap 4 is engaged over the stopper 3 and the piston 18 is in its deployed position, the plastic material of the stopper 3 melting in contact with the heating cannula 19.

The needle 15 and the heating cannula 19 are situated in an inner cavity 22 of the cap 4.

The pistons 14 and 18 can be actuated electrically or hydraulically. In order not to overload the figures, the electrical power or hydraulic actuating wires of the pistons 14 and 18 have not been shown in the figures. Likewise, the heating elements making it possible to heat the needle 15 or the heating cannula 19, as well as their respective power sources, have not been shown so as not to overload the figures.

The fluid injection means 6 comprise several fluid inlets adapted to receive a pressurized fluid and inject the latter inside the inner cavity 22 of the cap 4, the cap 4 being adapted to contain up to five fluid inlets 6.

In the first embodiment of the invention, the pressure-packaging method also comprises, before the step for engagement of the cap 4 on the stopper 2, a step for sterilization of the outer surface of the stopper 3 by punctual heating, chemical sterilization using a sterilizing liquid, steam, pulsed light emission or another similar method, in order to guarantee the destruction of the pathogenic organisms present on the outer surface of the stopper 3.

The inner cavity 22 of the cap 4 is still under sterile gas overpressure by a first fluid inlet 6, even before the engagement to maintain the sterility of the stopper 3 done beforehand.

There are two other sterile gas inlets 6 for the fluid introduction step, also called inflation step.

The last two fluid inlets 6 could be used for the injection of a sterilizing fluid after the engagement and the piercing and a rapid discharge by aspiration of the sterilizing fluid for the piercing.

The device 1 further comprises an optical camera C arranged in the inner cavity 22 of the cap 4 and configured to verify the sealing quality of the hole in the stopper 3 by the heating cannula 19. This step for verifying sealing quality will be described in more detail in reference to FIG. 6.

Figure 3:
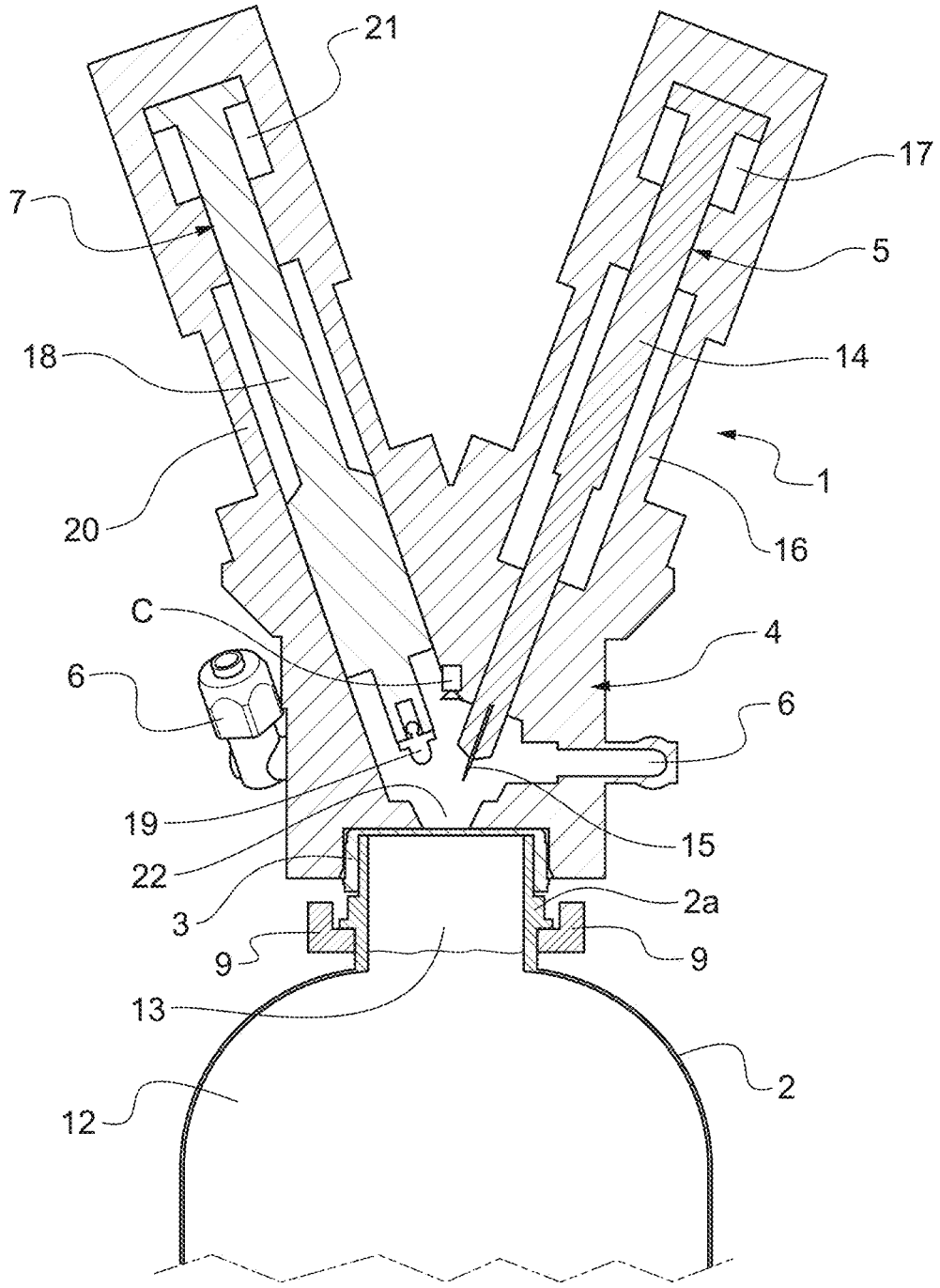
FIG. 3 is a sectional view similar to FIG. 2 during the engagement step.

FIG. 3 shows the pressure-packaging device 1 during the engagement step.

During the engagement step, the pistons 14 and 18 respectively of the needle 15 and the heating cannula 19 are in their retracted positions, also called idle positions.

The cap 4 is engaged sealingly over the outer surface of the stopper 3 such that at least part of the stopper 3 is inserted into at least part of the inner cavity 22 of the cap 4.

The pistons 14 and 18 are arranged in the cap 4 such that their respective movement axes are secant at a point located in the material of the stopper 3 or slightly above the latter when the cap 4 is engaged over the stopper 3, said point being located preferably at the center of the upper surface of the stopper 3, or slightly above, off-centered, based on the shape of the heating cannula 19.

The pressure-packaging method may also comprise, after the step for engagement of the cap 4 over the stopper 3, a step for circulating sterile fluid, preferably an inert gas such as nitrogen, in the inner cavity 22 of the cap 4 via certain fluid inlets 6. An overpressure is thus created between the stopper 3 and the cap 4 to maintain a positive pressure greater than or equal to the internal pressure of the container 2 until sealing by melting.

Figure 4:
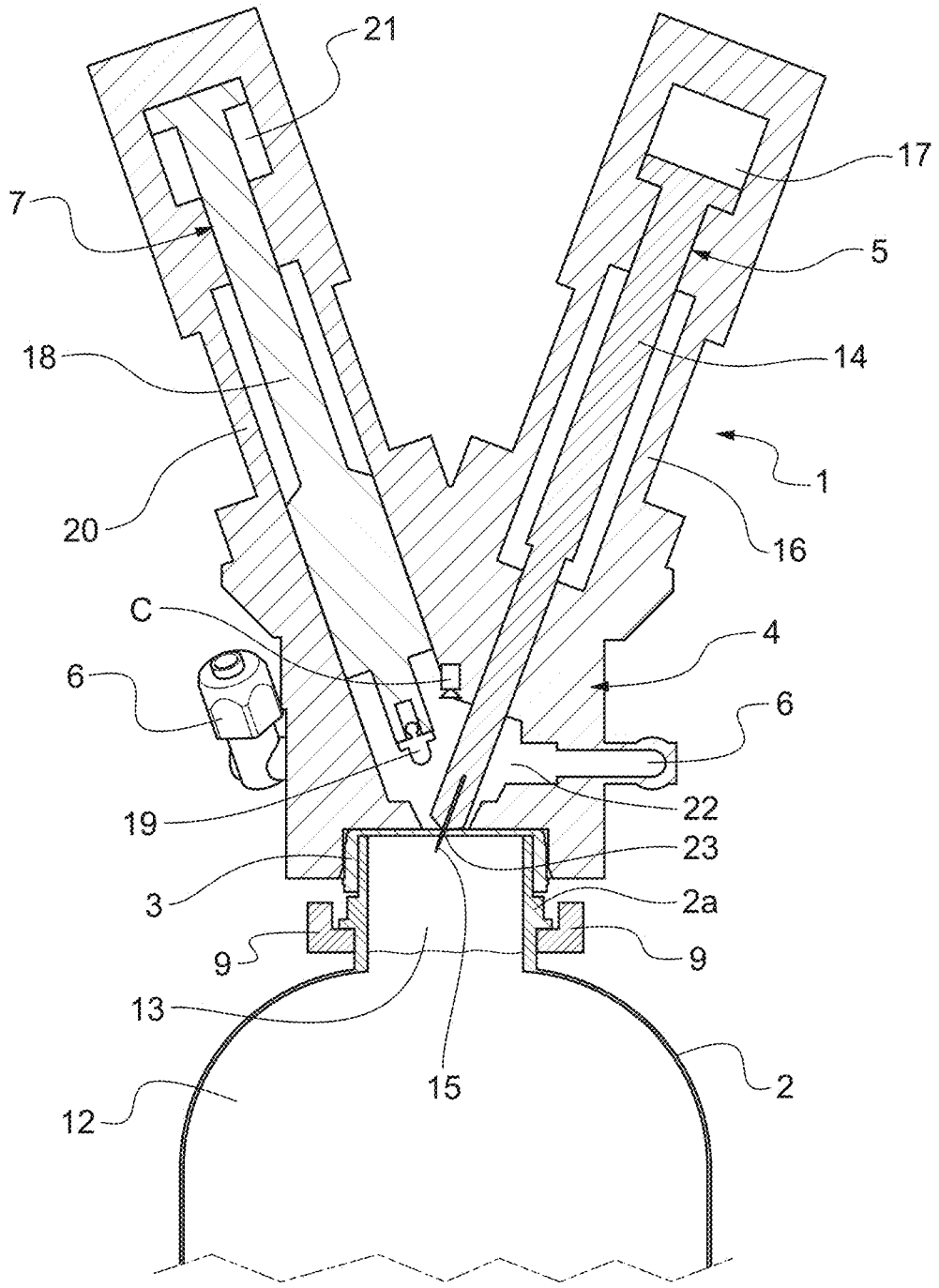
FIG. 4 is a sectional view similar to FIG. 2 during the piercing step.

FIG. 4 shows the pressure-packaging device 1 during the piercing step.

During the piercing step, the piston 14 of the needle 15 is in its deployed position, such that the needle 15 is lowered to the stopper 3 and pierces a hole 23 through the material of the stopper 3.

The needle 15 is never in contact with the contents 12 during the piercing.

The needle 15 makes the hole 23 by penetration in the plastic material of the stopper 3, by deformation and pushing back of the material, without tearing material.

In the first embodiment of the invention, this piercing step is immediately followed by a step for raising the needle 15 into the idle position of the piston 14.

The pressure-packaging method may also comprise a step for verification, using an optical or fiber-optic camera connected to an additional optical sensor (not shown in FIG. 4) arranged in the cap 4, of the integrity of the needle 15 after the step for raising the needle 15, thus making it possible to verify optically whether the needle 15 is or is not broken after the piercing step.

An additional optical camera offboard from the cap can inspect the filling level of the container 2 at the end of the pressure-packaging method to detect any break of the needle 15. Indeed, during normal processing, the level of the contents 12 must drop to a predetermined level, whereas in case of non-piercing and therefore non-introduction of fluid, the level of the contents 12 will not decrease.

A proximity sensor system could also verify the presence of the whole and unbroken needle 15, without deviating from the scope of the present invention.

Figure 5:
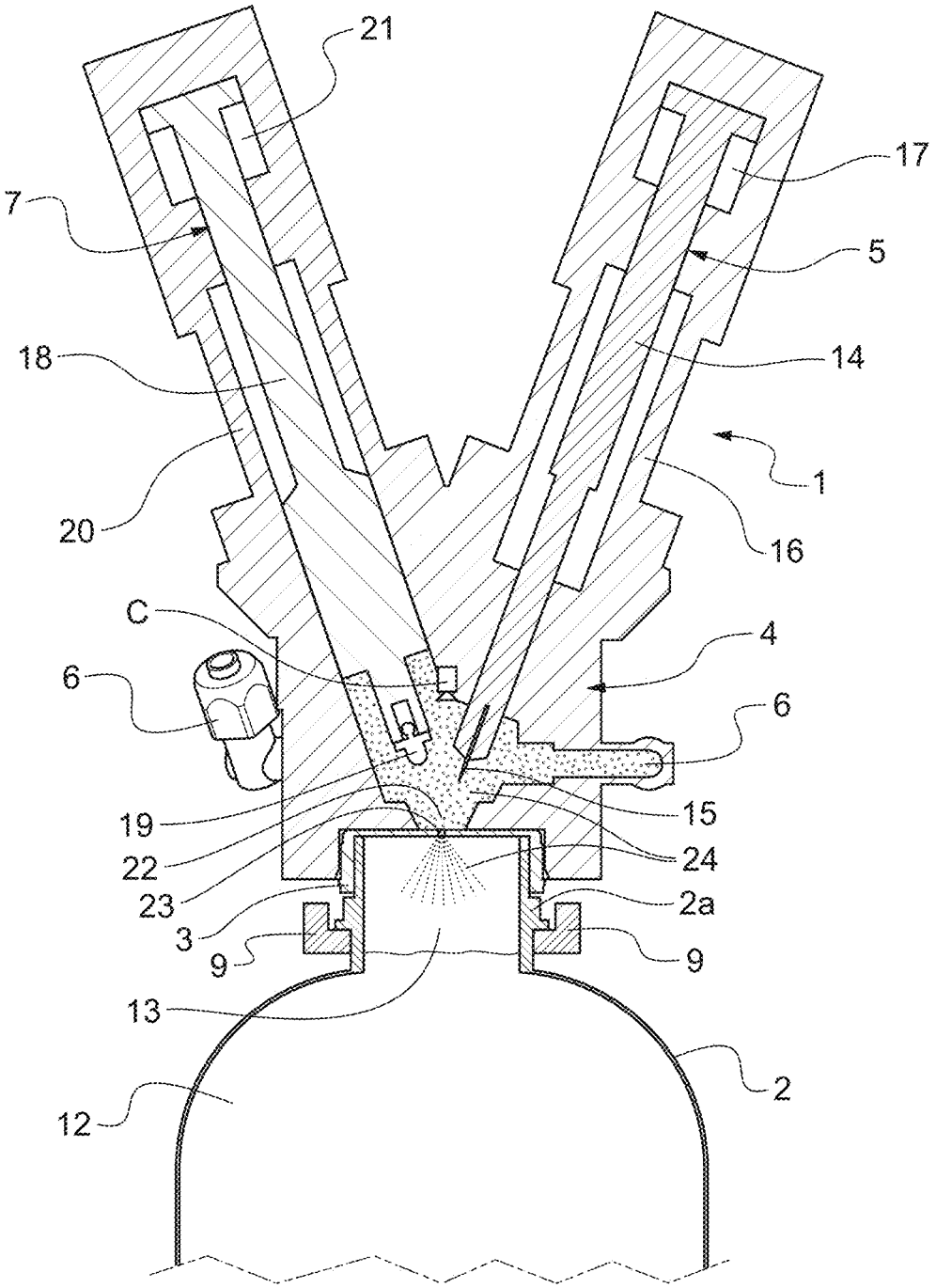
FIG. 5 is a sectional view similar to FIG. 2 during the fluid introduction step according to a first embodiment of the invention.

FIG. 5 shows the pressure-packaging device 1 during the fluid introduction step according to the first embodiment of the invention.

In the first embodiment of the invention, the needle 15 is cylindrical and solid and has a cone-shaped pointed end.

The needle 15 is preferably heated by a heating means (not shown in FIG. 5), the heating of the needle 15 making it possible both to sterilize the needle 15 and facilitate the piercing of the plastic material of the stopper 3. The needle 15 is preferably heated to a temperature above 95° C. for sterilization thereof and below 130° C. to avoid possible melting of the plastic material of the stopper 3 during piercing and adhesion of plastic particles on the needle 15, which could then detach during piercing of the stopper 3 of another container 2.

The temperature of the needle 15 is preferably maintained and monitored at all times by a resistance/probe placed in the piston 14.

In the first embodiment of the invention, during the fluid introduction step, the pistons 14 and 18 respectively of the needle 15 and the heating cannula 19 are in their idle positions, the solid needle 15 thus being removed from the hole 23 formed in the stopper 3. In this first embodiment, the sterilization of the outer surface of the stopper 3 before the engagement of the cap 4 over the stopper 3 is mandatory so as not to pollute the contents 12 during the introduction of fluid in the head space 13.

A fluid 24 is introduced into the inner cavity 22 of the cap 4, then into the head space 13 of the container 2 via the hole 23, arranged through the stopper 3, using one of the fluid inlets 6, so as to obtain a residual pressure at least equal to the atmospheric pressure in the head space 13 of the container 2.

The fluid 24 is an inert and sterile gas such as nitrogen, in particular in gaseous form, which makes it possible not to cause subsequent oxidation of the contents 12, after bottling. This avoids over-collapse due to later oxygen consumption, since there is none or very little, the inert gas having in large part replaced the initially confined air.

In the case of hot filling at a temperature above 73° C., the fluid 24 is introduced into the head space 13 after cooling of the contents 12 to a temperature below 45° C.

The introduction pressure of the fluid 24 is configured to generate a residual pressure in the container 2, between 1.01 bars and 2.5 bars, and preferably between 1.01 bars and 1.4 bars.

The step for introducing the fluid 24 into the head space 13 preferably comprises introducing fluid 24 in an initial phase at a first pressure value, then introducing fluid 24 in a final phase at a second pressure value below the first pressure value. It is thus possible to greatly increase the pressure in the initial pressurization phase immediately after the piercing, and to have a lower pressure in the final phase in order to adjust the final pressure just before the sealing by melting.

Figure 6:
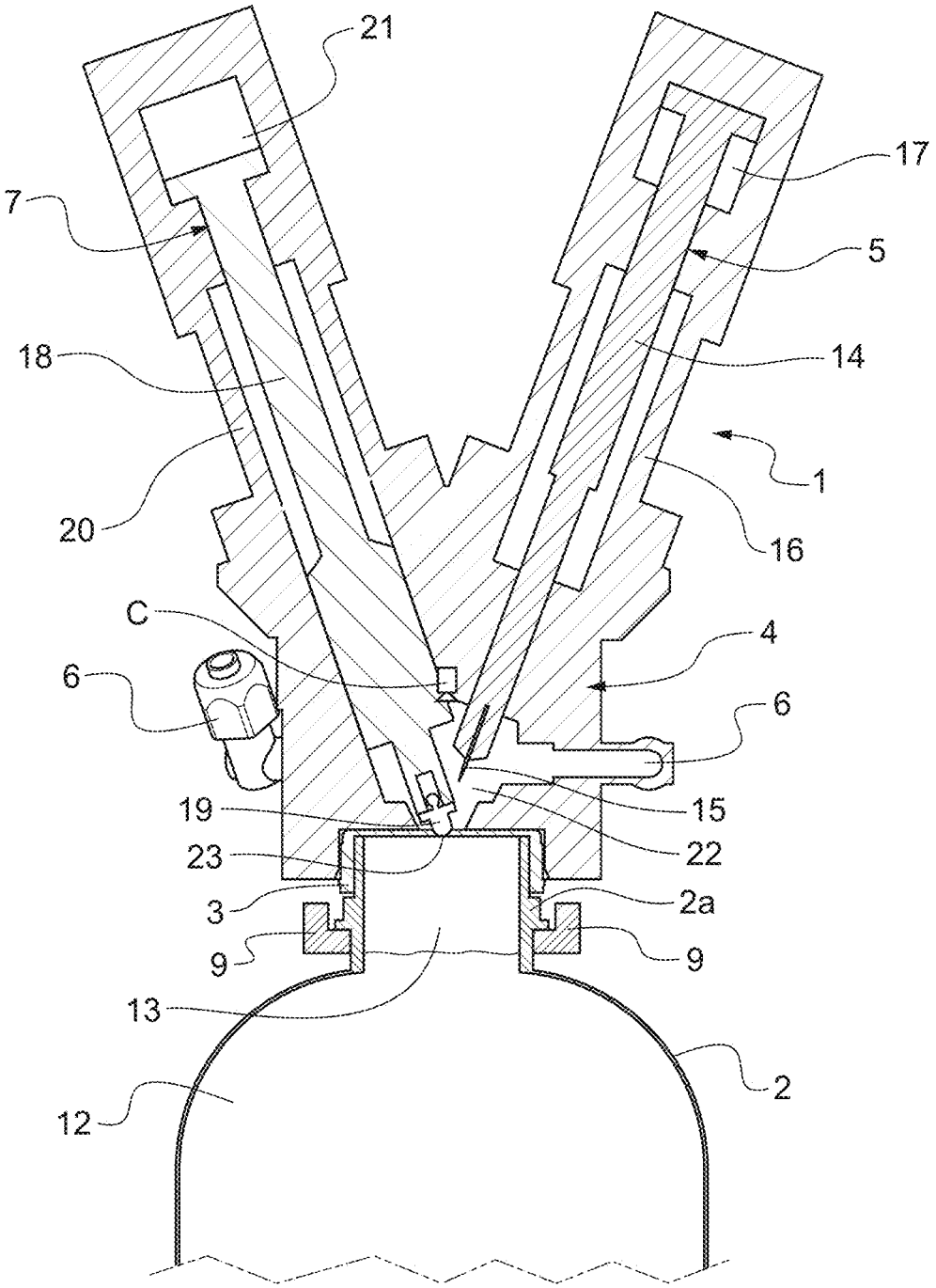
FIG. 6 is a sectional view similar to FIG. 2 during the sealing step.

FIG. 6 shows the pressure-packaging device 1 during the sealing step.

During the sealing step, the piston 18 of the heating cannula 19 is in its deployed position, such that the heating cannula 19 is lowered to the hole 23 formed in the stopper 3 by the needle 15.

The heating cannula 19 makes it possible to re-stopper, by melting of the plastic material of the stopper 3, the hole 23 formed in the stopper 3, which makes it possible to guarantee the final tightness of the container 2 while compensating the vacuum in the container 2.

The sealing step is carried out in a period of between 0 and 5 seconds.

The pressure-packaging method can also comprise a step for verification, using an optical camera C arranged in the inner cavity 22 of the cap 4, of the sealing quality of the hole 23 by the heating cannula 19, which thus makes it possible to verify optically whether the sealing quality of the hole 23 by the heating cannula 19 is good or bad. The sealing leaves, on the upper surface of the stopper, a mark characteristic of the sealing quality by the heating cannula 19.

Said verification step comprises the following sub-steps: the capture, by the optical camera C, of an image of the stopper 3 at the circular seal formed by the hemispherical heating cannula 19; the measurement of the diameter of the captured circular seal; and the comparison of the measured diameter to a threshold value in order to determine whether the sealing quality is acceptable.

The optical camera C thus allows a visual inspection of the sealing to measure the penetration of the heating cannula 19 and to guarantee the quality of the weld.

The sealing step is followed by a step for raising the heating cannula 19 into the idle position of the piston 18, then a step for removing the cap 4 from the stopper 3.

The method according to the present invention allows the hot filling in containers 2, for example made from PET, with reduced grammages of about 15% relative to the hot filling method with deformation of the container, which is a considerable material reduction in light of the multiplier coefficient of the number of containers 2 produced.

No particular architecture must be studied for the wall; any technical panel and/or complex petaloid bottom becomes unnecessary.

The shapes of containers 2 are in fact much freer and plainer, and recycling is less expensive, since less material is used.

Placing the container 2 under atmospheric pressure or slight pressure allows better stacking and palletizing.

The method according to the present invention applies to all filling modes, and even to pressurizing of containers 2 cold filled under sterile atmospheres for which one wishes not only to compensate a potential decrease in the volume of the head space 13 by consumption of the oxygen, but also to create a slight overpressure to reinforce the mechanical strength, or even to inject a neutral gas to replace air confined in the head space 13 in order to preserve all of the organoleptic properties of the products that oxidation may alter.

Figure 7:
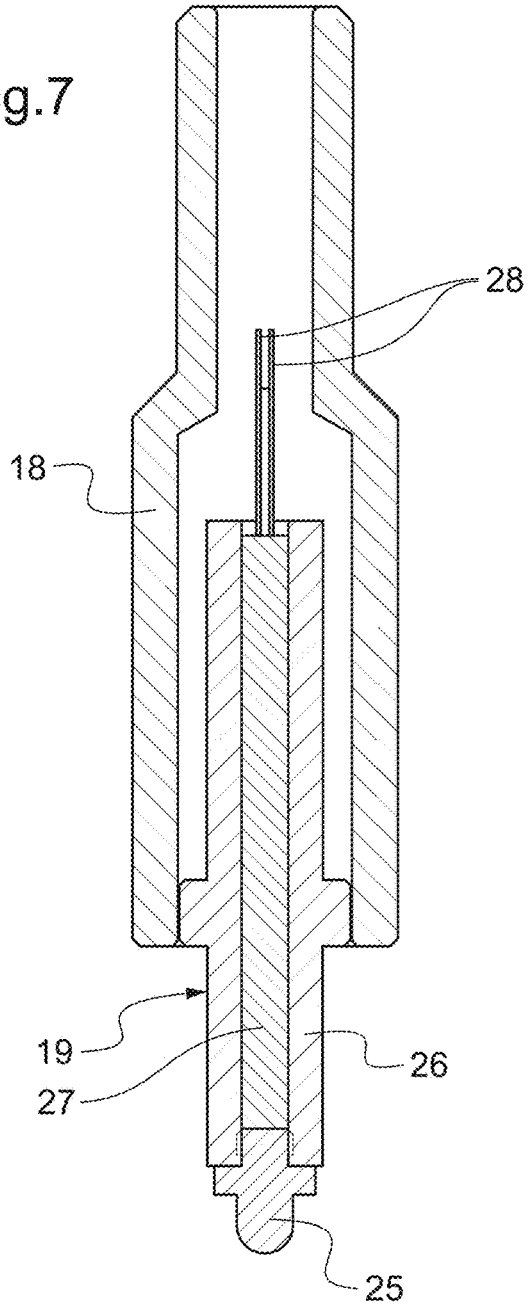
FIG. 7 is a sectional view of the heating cannula of the device of FIG. 1.

FIG. 7 shows the heating cannula 19 of the pressure-packaging device 1.

The heating cannula 19 comprises a cannula end 25 (which will be described in more detail in FIG. 8) and a hollow and cylindrical cannula holder 26 in which a part of the cannula end 25 is forcibly fitted, a cannula holder 26 part being forcibly fitted in the lower part of the piston 18, which is hollow.

A heating resistance/temperature probe 27 is arranged inside the hollow cannula holder 26, the lower part of the heating resistance/temperature probe 27 being in contact with the cannula end 25, and the upper part of the heating resistance/temperature probe 27 being connected to two electrical wires 28 configured to bring electrical power to the heating resistance/temperature probe 27.

The temperature of the cannula end 25 and the contact time can be configured individually to obtain the desired penetration/welding and are monitored continuously by the pressure-packaging device 1.

The temperature of the cannula end 25 is about 140° C.-220° C., preferably about 180° C.-200° C., as a function of the material making up the stopper 3, to guarantee the rapid melting of the plastic material of the stopper 3.

A minimal force, for example using an hydraulic cylinder controlled at 7 bars, is applied to the heating cannula 19 to guarantee significant compression of the plastic during the melting phase to fill the hole 23. Insufficient pressure of the heating cannula 19, despite the correct temperature and the correct contact time, would indeed compromise the quality/tightness of the welding.

A water cooling circuit (not shown in FIG. 7) placed in the cap 4 preferably guarantees that the cap 4 is kept at a "reasonable" temperature.

Figure 8:
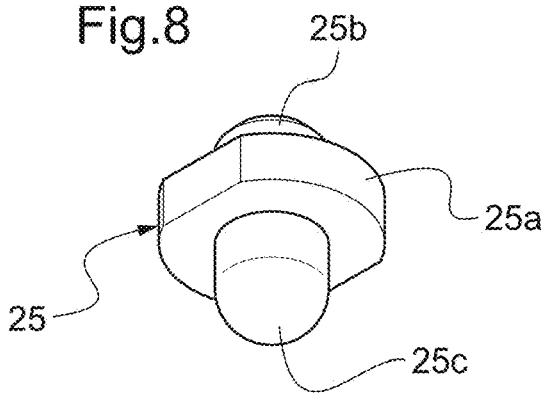
FIG. 8 is a perspective view of the end of the heating cannula of FIG. 7.

FIG. 8 shows the cannula end 25.

The cannula end 25 comprises a plate 25*a*, one of the faces of which comprises a protrusion 25*b* configured to fit forcibly in the cannula holder 26, and the other opposite face of which comprises a hemispherical lug 25*c*. It should be noted that the illustrated hemispherical shape is not limiting, and that any convex shape of the end of the heating cannula is within the scope of the present invention.

The hemispherical shape of the lug 25*c* makes it possible to perform a precise verification of the sealing quality by the heating cannula 19 of the hole 23 formed in the stopper 3 by the needle 15. Indeed, the seal formed by the hemispherical lug 25*c* is circular, which makes it possible to measure, using the optical camera C, the diameter of the produced circular seal in order to determine whether the sealing quality is acceptable.

Figure 9:
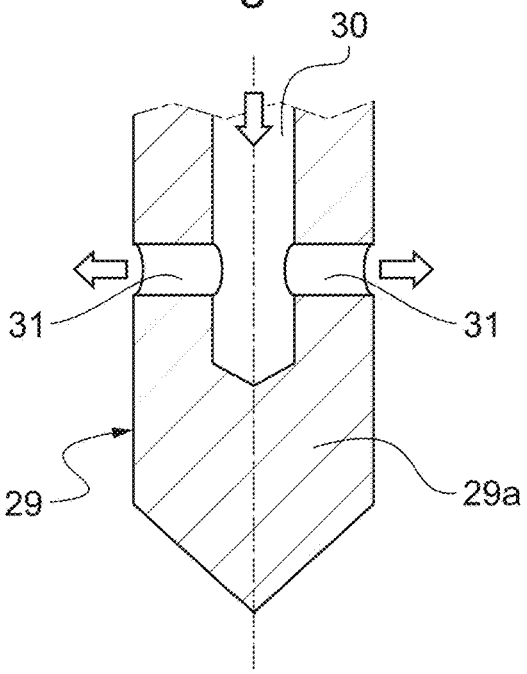
FIG. 9 is a sectional view of the needle of the device of FIG. 1 according to a second embodiment of the invention.

FIG. 9 shows a needle 29 of the pressure-packaging device 1 according to the second embodiment.

In this second embodiment of the invention, the pointed end 29*a* of the needle 29 is solid, and the rest of the needle comprises a longitudinal central bore 30 and two opposite lateral holes 31 connecting said central bore 30 with the outside of the needle 29 near the pointed end 29*a* of the needle 29.

It should be noted that the needle 29 could also comprise at least three lateral holes 31, without deviating from the scope of the present invention.

In this second embodiment, the fluid injection means 6 comprises at least one fluid inlet adapted to receive the fluid 24 and to inject it into the central bore 30 of the needle 29 at the end of the needle 29 opposite the pointed end 29*a*. The needle 29 is kept in the hole 23 during the fluid introduction step, the fluid introduction being done through the central bore 30, then the two lateral holes 31.

An introduction of the fluid 24 into the head space 13 of the container 2 is thus done while the needle 29 is still in its piercing position, the fluid 24 being spread laterally in the head space 13 through the two lateral holes 31, thus making it possible to avoid the creation of any turbulence of the contents 12 and splashes during the fluid introduction. This second embodiment also makes it possible to avoid the prior sterilization of the outer surface of the stopper 3.

The device, the method and the machine according to the invention can be implemented in a production line, with one or several stations upstream or downstream, in which case a conveying device will transport the contents to the station of the production line carrying out the invention.

The invention claimed is:

1. A device for pressure-packaging a container to be processed at least partially filled with contents and stoppered in a tight manner by a stopper arranged over a head space of the container, the device comprising a cap with a piercing needle located therein, fluid injection means and a heating cannula for sealing by melting, the cap being configured to be engaged sealingly over the outer surface of the stopper, the needle being adapted to move linearly to pierce a hole through the stopper, the fluid injection means being configured to introduce a fluid in the head space via the hole, the heating cannula being adapted to move linearly to seal the hole by melting the material of the stopper, wherein the needle and the heating cannula are arranged in the cap such that their respective axes of movement are secant at a point located at one of in the material of the stopper and above the material of the stopper when the cap is engaged over the stopper, and wherein the end of the heating cannula is convex.

2. The device according to claim 1, further comprising an optical means configured to verify the sealing quality of the hole in the stopper by the heating cannula.

3. The device according to claim 1, further comprising one of optical means and inductive means arranged in the cap and configured to verify the integrity of the needle after the piercing of the hole.

4. The device according to claim 1, wherein the needle has a pointed and cone-shaped end.

5. The device according to claim 4, wherein the needle is solid, the fluid injection means comprising at least one fluid inlet adapted to receive a pressurized fluid and to inject the latter inside the cap engaged sealingly over the stopper.

6. The device according to claim 4, wherein the pointed end of the needle is solid, and the rest of the needle comprises a longitudinal central bore and at least two lateral holes connecting the central bore with the outside of the needle near the pointed end of the needle, the fluid injection means comprising at least one fluid inlet adapted to receive a pressurized fluid and to inject the the pressurized fluid into the central bore of the needle at the end of the needle opposite the pointed end of the needle.

7. The device according to claim 1, wherein the needle is heated by a heating means.

8. A method for pressure-packaging a container to be processed at least partially filled with contents and stoppered in a tight manner by a stopper arranged over a head space of the container, using a pressure-packaging device according to claim 1, wherein the method comprises the following steps:

sealingly engaging the cap of the device over the outer surface of the stopper;

piercing a hole through the stopper using the needle of the device;

introducing a fluid in the head space of the container by means of the hole, arranged through the stopper, using fluid injection means of the device, so as to obtain a residual pressure at least equal to the atmospheric pressure in the head space of the container;

sealing the hole by melting of the material of the stopper using the heating cannula; and removing the cap.

9. The method according to claim 8, wherein the fluid injection means comprise at least one fluid inlet adapted to receive a pressurized fluid and to inject the latter inside the cap engaged sealingly over the stopper and wherein the needle is removed from the hole before the fluid introduction step.

10. The method according to claim 8, wherein the pointed end of the needle is solid, and the rest of the needle comprises a longitudinal central bore and at least two lateral holes connecting the central bore with the outside of the needle near the pointed end of the needle, the fluid injection means comprising at least one fluid inlet adapted to receive a pressurized fluid and to inject the the pressurized fluid into the central bore of the needle at the end of the needle opposite the pointed end of the needle and wherein the needle is kept in the hole during the fluid introduction step, the fluid introduction being done through the central bore and the at least two lateral holes of the needle.

11. The method according to claim 8, wherein the method further comprises, after the sealing step, a step for verifying the sealing quality of the hole in the stopper using the optical means.

12. The method according to claim 11, wherein the verification step comprises the following sub-steps:

the capture, by the optical means, of an image of the stopper at the circular seal formed by the convex heating cannula;

the measurement of the diameter of the captured circular seal; and the comparison of the measured diameter to a threshold value in order to determine whether the sealing quality is acceptable.

13. The method according to claim 8, wherein the fluid introduction step into the head space comprises an introduction of fluid in an initial phase at a first pressure value, then introduction of fluid in a final phase at a second pressure value lower than the first pressure value.

14. The method according to claim 8, wherein, in the case of hot-filling at a temperature above 73° C., the fluid is introduced in the head space after cooling of the contents to a temperature below 45° C.

15. The method according to claim 8, wherein the fluid introduction pressure is configured to generate a residual pressure in the container, comprised between 1.01 bars and 2.5 bars.

16. The method according to claim 8, wherein the fluid is an inert and sterile gas.

17. The method according to claim 8, wherein the method further comprises a step for circulating sterile fluid between the cap and the stopper.

18. The method according to claim 8, wherein the method further comprises, before the step for engagement of the cap over the stopper, a step for sterilization of the outer surface of the stopper by one or several from among punctual heating, chemical sterilization, vapor, an emission of pulsed light.

* * * * *